United States Patent [19]

Eheim

[11] 4,308,834

[45] Jan. 5, 1982

[54] FUEL INJECTION PUMP FOR SUPERCHARGED DIESEL INTERNAL COMBUSTION ENGINES, IN PARTICULAR A DISTRIBUTOR-TYPE INJECTION PUMP

[75] Inventor: Franz Eheim, Stuttgart, Fed. Rep. of Germany

[73] Assignee: Robert Bosch GmbH, Stuttgart, Fed. Rep. of Germany

[21] Appl. No.: 80,914

[22] Filed: Sep. 28, 1979

[30] Foreign Application Priority Data

Nov. 2, 1978 [DE] Fed. Rep. of Germany ..... 2847572

[51] Int. Cl.[3] ..... F02D 1/06; F02D 1/14

[52] U.S. Cl. ..... 123/383; 123/369; 123/387; 123/503

[58] Field of Search ..... 123/369, 383, 387, 393, 123/503, 379, 380, 382

[56] References Cited

U.S. PATENT DOCUMENTS

| | | | |
|---|---|---|---|
| 3,033,186 | 5/1962 | Staege | 123/369 |
| 3,946,716 | 3/1976 | Konrath | 123/387 |
| 4,200,076 | 4/1980 | Straubel | 123/369 |

FOREIGN PATENT DOCUMENTS

| | | | |
|---|---|---|---|
| 2448656 | 5/1975 | Fed. Rep. of Germany | 123/380 |

*Primary Examiner*—Ira S. Lazarus
*Assistant Examiner*—Carl Stuart Miller
*Attorney, Agent, or Firm*—Edwin E. Greigg

[57] ABSTRACT

A fuel injection pump is disclosed for supercharged Diesel internal combustion engines, in particular, a distributor-type injection pump in which the full-load fuel supply quantity is limited by means of a variable stop, controlled in accordance with rpm and air quantity. The injection pump includes a control apparatus whose control member forms a three-dimensional cam, which is rotated by a charge pressure control element and is displaced in the longitudinal direction by a hydraulic adjustment piston actuated in accordance with the rpm level. The three-dimensional surface of the cam includes protuberances whose profile is picked up and transmitted to a full-load stop of an rpm regulator located in an interior chamber of the injection pump, while the adjustment piston, in abutting relationship with the three-dimensional cam, is actuated for axial movement by the pressure of the fuel located in the interior chamber of the pump, and controlled in accordance with rpm.

13 Claims, 4 Drawing Figures

FUEL INJECTION PUMP FOR SUPERCHARGED DIESEL INTERNAL COMBUSTION ENGINES, IN PARTICULAR A DISTRIBUTOR-TYPE INJECTION PUMP

BACKGROUND OF THE INVENTION

The invention relates to a fuel injection pump for supercharged Diesel internal combustion engines, in particular a distributor-type injection pump. A fuel injection pump of this kind, embodied as a distributor-type injection pump, is already known: distributor-type injection pump Model VE..F.. with a charge-pressure-dependent full-load stop, made by Robert Bosch GmbH, Stuttgart; see also the Technical Customer Service Notice VDT-I-460/1, Supplement 2, of May 1977 or the SAE Paper number 76 0127 from the Automotive Engineering Congress in Detroit, Mich. Feb. 23–27, 1976. In the fuel injection pump of known type, the position of the full-load stop for the rpm regulator is integrated into the pump housing, which position determines the maximum permissible fuel supply quantity, and is corrected exclusively in accordance with the charge pressure of the intake air supplied to the engine. A charge-pressure-dependent correction of this kind has the disadvantage, however, that the increase in the fuel quantity controlled thereby occurs with a time lag during engine acceleration; this lag occurs because the charge air pressure is the independent variable upon which fuel supply increases depend, and yet this charge air pressure is itself dependent for increases, in engines having an exhaust turbo-supercharger, upon a previous increase in the exhaust gas pressure and the exhaust gas temperature. This mutual interdependence of the fuel supply, charge pressure and exhaust gas pressure acts to undermine the behavior during acceleration of an engine equipped with an exhaust-driven turbo-supercharger; moreover, it is difficult to stay within the permissible limits for smoke emissions and at the same time attain optimal acceleration, because the permissible fuel supply quantity furnished for a given charge pressure, while considering the emissions limit, is very heavily dependent on the rpm level at a given moment. This rpm level dependence is not identical at every charge pressure; indeed, plotting the various curves for the permissible fuel supply quantities at a constant charge pressure over the rpm range reveals a variably steep slope in each charge pressure range. A control apparatus equipped with a three-dimensional cam has been proposed, in German Offenlegungsschrift No. 26 37 520, which enables a correction of the full-load stop in accordance with rpm and air quantity. The control apparatuses therein proposed are very expensive, due to their consumption of structural space, and in the case of distributor-type injection pumps having integrated rpm regulators, such an apparatus makes it necessary to provide an entirely new housing structure, thus nullifying the inherent advantage of the small external dimensions in distributor-type injection pumps. In addition, the centrifugal regulator built into the distributor-type injection pump cannot be used simultaneously as the rpm control element for the three-dimensional cam, because this dual-function requirement would have a detrimental impact on the regulator function.

OBJECTS AND SUMMARY OF THE INVENTION

It is an object of the invention to provide a fuel injection pump which has the principal advantage over the prior art that despite the use of a three-dimensional cam to control the full-load stop (which is known per se), a space-saving disposition of the control apparatus is possible.

It is another object of the invention to use the already-available, rpm-controlled pressure of the fuel located in the interior of the injection pump as the rpm-dependent initial variable so that the functioning of the rpm regulator is not restricted, no additional rpm control element is required, and the adjustment piston which directly contacts the three-dimensional cam does not require an adjustment gear means which would produce inherent friction and would require additional structural space.

A further object of the invention is to provide that both the adjustment piston and the three-dimensional cam require only a single, common restoring spring.

Thus, a further object of the invention is provided by a particularly compact structure which is attained when the adjustment piston is embodied as a movable wall and is guided within an intermediate wall which separates the interior thereof from a chamber enclosing the three-dimensional cam.

A further object of the invention is provided wherein the adjustment piston assumes the function of a radial end support for the adjustment shaft, which advantageously causes a further simplification in operating function and reduction in the number of parts required in the pump control mechanism.

A still further object of the invention is provided which makes it possible to attain a bearing for the adjustment shaft creating low friction and lacking susceptibility to errors in alignment of the shaft.

A still further object of the invention is provided which render the three-dimensional cam actuatable entirely free of play in the longitudinal direction, and with the least possible amount of play in the rotary direction.

A still further object of the invention is achieved wherein a cylindrical portion of the three-dimensional cam can also function as the adjustment piston, as a result of which the three-dimensional cam itself assumes the second function of an rpm control element.

A final object of the invention is provided wherein a third operational characteristic of the engine influencing the permissible fuel supply quantity, preferably a temperature of some engine fluid, can advantageously be taken into consideration.

The invention will be better understood as well as further objects and advantages thereof become more apparent from the ensuing detailed description of preferred embodiments taken in conjunction with the drawings.

DESCRIPTION OF THE PREFERRED EMBODIMENTS

Figure 1:
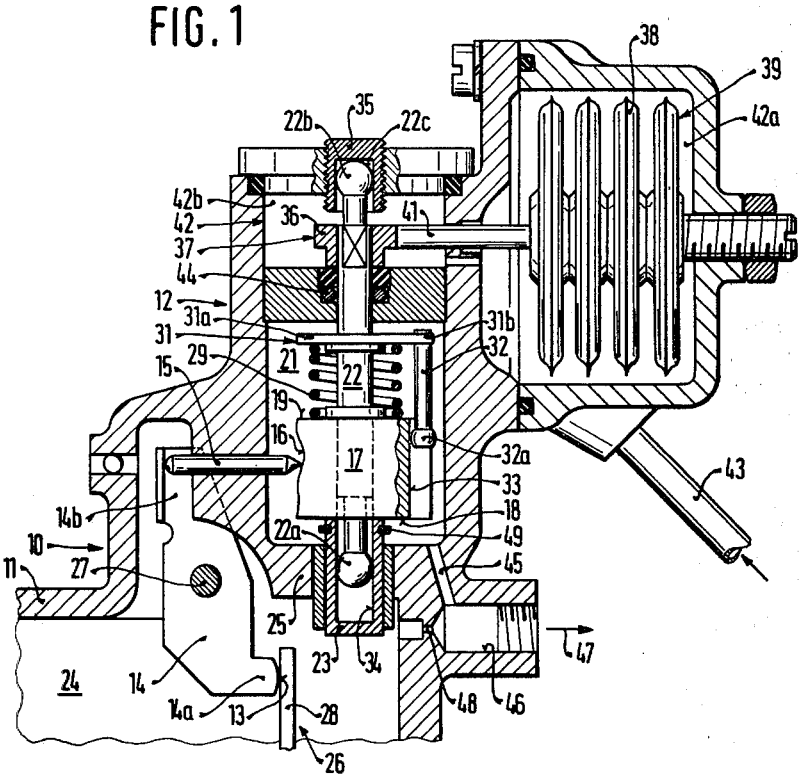
FIG. 1 is a longitudinal cross-sectional view taken through the portion of a distributor-type injection pump relating to the invention.

Turning now to the first exemplary embodiment, shown only in part in FIG. 1, we are concerned with a reciprocating piston, distributor-type injection pump of the VE..F.. design of Robert Bosch GmbH, Stuttgart, which is mass-produced and known from the publications cited above. The basic structure of this pump will be described in further detail below in connection with FIG. 4.

The injection pump 10 is intended for installation on supercharged Diesel engines, and provided on the pump housing 11 is a control apparatus 12, which serves to provide a fuel supply correction dependent upon both rpm and air quantity by means of a full-load stop 13. This full-load stop 13 is embodied as the spherical end portion of one arm 14*a* of a two-armed stop lever 14, the second arm 14*b* of which abuts a pickup pin 15 which functions as an input transmission element. The pickup pin 15 is guided through an aperture in the wall of the pump housing 11 which it engages in a slidable frictional contact thus preventing the passage of fuel; the pin 15 abuts against a surface 16 of a three-dimensional cam 17 which acts as the control element for the control apparatus 12.

The three-dimensional cam 17 approximates a cylindrically shaped element which is provided on its periphery with the three-dimensional cam surface 16 and a pair of end faces 18, 19 in parallel planes; the cam is supported, displaceable in the direction of its longitudinal axis, on an adjustment shaft 22 within a chamber 21 under atmospheric pressure. The first end face 18 of the three-dimensional cam 17 is in constant abutting contact with an adjustment piston 23, which is movably guided in fluid-tight sliding engagement within an intermediate wall 25 which separates the chamber 21 from an interior chamber 24 of the injection pump 10.

The interior chamber 24 of the distributor-type injection pump 10 is filled with fuel under the rpm-controlled pressure of a pre-supply pump; this chamber 24 acts simultaneously as the suction chamber of the pump and, as is explained in further detail in connection with FIG. 4, includes a mechanical rpm regulator 26. Of this regulator FIG. 1 shows only the stop lever 14, provided with the full-load stop 13, which is borne on a shaft 27 attached to the housing 11 and a tension lever 28 against which the full-load stop 13 comes into abutment.

The pressure of the fuel located in the interior chamber 24, which in known manner actuates the adjustment piston of an injection timing adjuster, acts upon the adjustment piston 23 so that this piston 23, in accordance with the rpm-controlled pressure of the fuel, axially displaces the three-dimensional cam 17 against the force of a restoring spring 29; that is, the piston 23 moves the cam 17 into a position in which equilibrium prevails between the hydraulic fuel pressure force and the tension in the restoring spring 29. The restoring spring 29 which includes opposite zones abuts at one extremity or zone the end face 19 of the three-dimensional cam 17, and at the other zone or extremity it abuts a one-armed lever 31 positively mounted on the adjustment shaft 22. The hub 31*a* of this lever 31 functions as the countersupport for the restoring spring 29 and a guidance pin 32 which is secured to the lever arm 31*b* of this lever 31. The guidance pin 32 extends parallel to the longitudinal axis of the adjustment shaft 22 and is provided with a spherical guidance head 32*a* at one end which head engages a longitudinal groove 33 cut in the periphery of the three-dimensional cam 17. This pin, head and groove arrangement provides a rotary drive means for the three-dimensional cam 17.

Both ends 22*a* and 22*b* of the adjustment shaft 22 are provided with spherical means. A central blind bore 34 in the adjustment piston 23, whose aperture opens toward the three-dimensional cam 17, provides a radial end support for the one end 22*a* of the adjustment shaft 22, whose other end 22*b* is guided and enclosed within a second end support 35 acting simultaneously as a radial and axial support. A convex end face 22*c* of the end 22*b* of the adjustment shaft 22, which end 22*b* is guided in the second end support 35, abuts the second end support 35; this convex end face 22*c* and the spherical means of the end 22*b* may, as is shown in FIG. 1, be provided by forming the end 22*b* as a ball; to achieve this end, a mass-produced ball intended for a ball bearing can be welded to the end of the shaft 22.

Adjacent to the end support 35 and the end 22*b*, an adjustment lever 36 is mounted on the adjustment shaft 22 to function as part of an adjustment gear means 37 which acts to rotate the three-dimensional cam 17. The adjustment lever 36 is actuated through an adjustment rod 41 extending into a diaphragm pressure box and secured to a diaphragm 38 of a charge pressure control element 39. In a manner known per se and therefore not further described herein, the adjustment lever 36 is retained by means of a spring in contact with the adjustment rod 41 associated with the adjustment gear means 37. Naturally, alternative known types of adjustment gear means, such as a rack drive, can also be used to transfer the axial motion of the charge pressure control element 39 into rotary motion of the adjustment shaft 22. A chamber 42*a*, including the diaphragm 38, and a chamber 42*b*, enclosing the adjustment drive means 37, comprise an interconnected housing chamber 42, which is subjected to the charge pressure of the Diesel engine via a charge air line 43 and is sealed off from the chamber 21, containing the three-dimensional cam 17, under atmospheric pressure by a seal 44, here embodied as an O-ring. The chamber 21 in turn, as hereinabove described, is sealed off from the interior chamber 24 of the distributor-type injection pump 10 by means of the tight friction fit of the adjustment piston 23. Chamber 21 communicates via an oil relief line 45 with a pipe bore 46 for a fuel return line 47, indicated only by an arrow, of the injection pump 10, so that fuel which might possibly leak into chamber 21 is not allowed to back up in the chamber 21. Between the pipe bore 46 and the interior chamber 24, an overflow bore 48 is provided to permit a limited escape of fuel, which is partially mixed with air, out of the interior chamber 24 to the fuel return line 47, yet the bore 48 is so small that it does not prevent the desired buildup of the rpm-dependent fuel pressure prevailing in the interior chamber 24.

As a result of the fuel pressure in the interior chamber 24, the adjustment piston 23 is maintained in constantly abutting relationship with the end face 18 of the three-dimensional cam 17, which cam in turn is subject to the force of the restoring spring 29, which spring in turn, via the lever 31 which acts as a countersupport, urges the adjustment lever 22 against the second end support 35 to retain it in position. In order to avoid the adjustment piston 23 falling into the interior chamber 24 in the event that the chamber becomes pressure-free, the piston 23 is provided with a safety ring 49.

Figure 2:
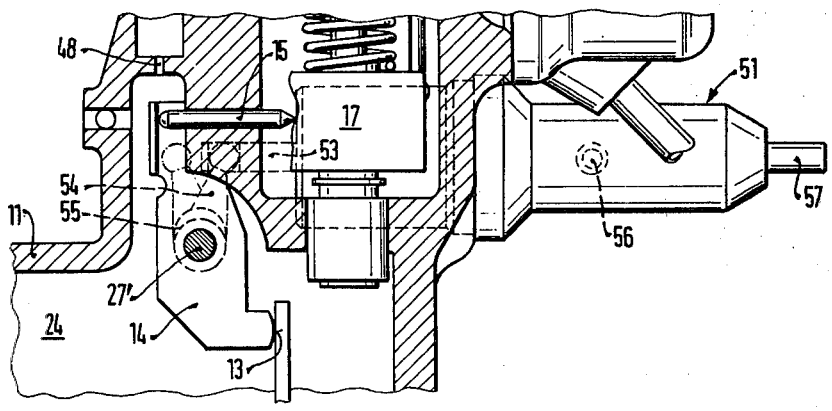
FIG. 2 is a partial longitudinal cross section of a second exemplary embodiment of the invention according to FIG. 1, wherein a third initial variable is taken into consideration.
Figure 3:
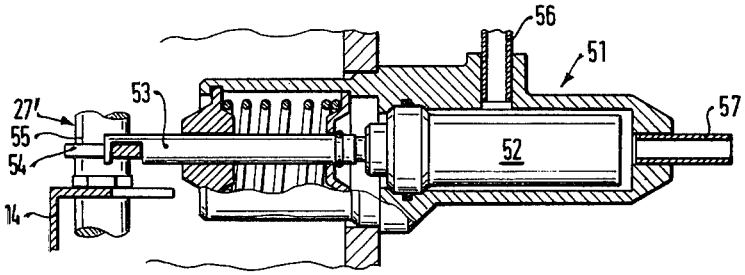
FIG. 3 is a cross-sectional view along the line III—III of FIG. 2.

The second exemplary embodiment, shown only in distinguishing detail from the first embodiment in FIGS. 2 and 3, differs from the first exemplary embodiment in the provision therein of a third control element 51 operating in accordance with temperature. Control element 51 is equipped with an expansion element transducer 52 (as shown in FIG. 3) surrounded by engine coolant which, via an adjustment rod 53 and a lever 54 connected to an eccentrically-operative shaft 27', controls the displacement of the stop lever 14. An eccentric bearing 55 on the shaft 27' is disposed in such a manner that as a result of the actuation of the lever 54, the shaft 27' is shifted in the direction of movement that the full-load stop 13 is displaced by the three-dimensional cam 17, so that a correctional movement made in accordance with temperature control is additively imposed on the full-load stop 13 in addition to the correctional movement supplied by the three-dimensional cam 17 in response to fuel pressure as controlled in accordance with rpm and air quantity. Alternatively, in place of the control element 51 functioning in accordance with temperature, some other correcting control element dependent upon a different engine operating variable can also be used. Thus, in place of the coolant flowing in and out via lines 56 and 57, the pressurized charge air or the exhaust gas could also be delivered to the expansion-element transducer 52, so that a correctional movement of the full-load stop 13 could be made dependent upon the control of charge air temperature or exhaust gas temperature. Deviating from the embodiment of FIG. 1, the overflow bore 48 in FIG. 2 is disposed at the highest point of the interior chamber 24, so that certain and reliable ventilation of the interior chamber 24 is assured.

Figure 4:
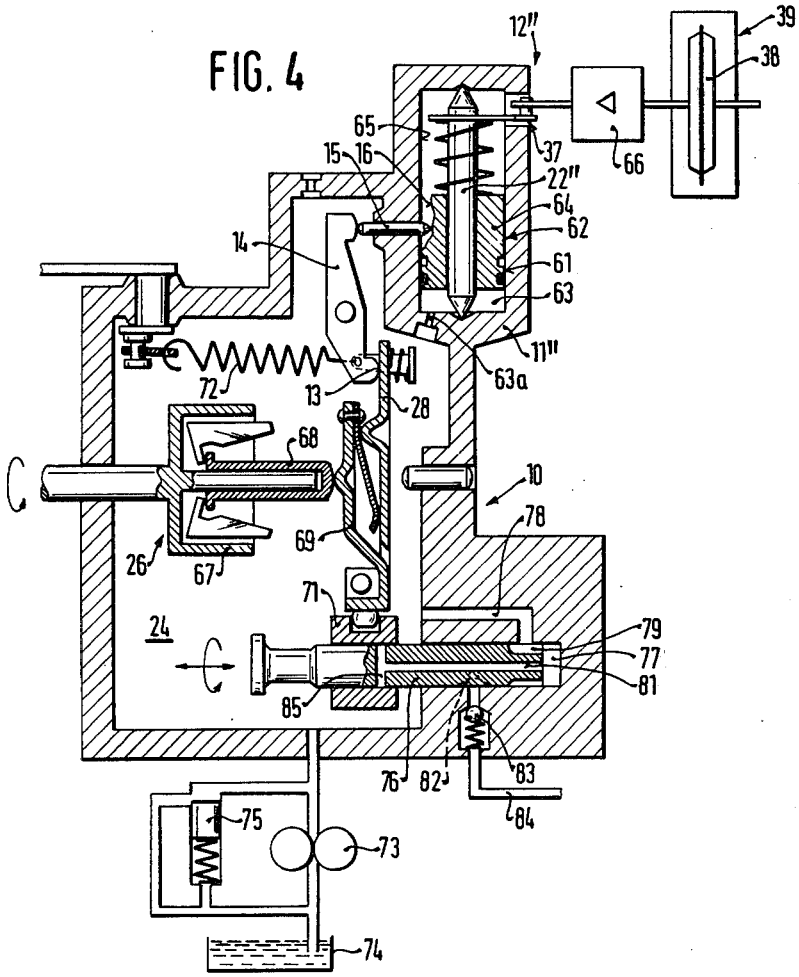
FIG. 4 is a simplified cross-sectional view of a third exemplary embodiment of the invention.

Referring now to the greatly simplified third exemplary embodiment shown in FIG. 4, the control apparatus is designated 12" and differs from the control apparatus 12 of FIG. 1 essentially in that the cylindrical lower portion 61 of the three-dimensional cam, here designated 62, simultaneously acts as the adjustment piston for the three-dimensional cam 62. The cam is axially displaceable on an adjustment shaft 22" positively mounted in the housing 11" and is exposed to the pressure of the fuel located in a pressure chamber 63. The pressure chamber 63 communicates via a throttled connecting bore 63*a* with the interior chamber 24 of the reciprocating piston distributor-type injection pump 10 and thus may be considered to be part of the pump. The cylindrical lower portion 61 of the three-dimensional cam has the same diameter as an upper portion 64 of the three-dimensional cam 62, which upper portion 64 bears the three-dimensional cam surface 16 proper; however, as is shown, the lower portion 61 can also be of larger diameter, so that the bore 65 including the three-dimensional cam 62 can be manufactured by a continuous production method. As in the first exemplary embodiment, the rotation of the three-dimensional cam 62 is effected by a charge pressure control element 39 equipped with a diaphragm 38, via an adjustment link means 37. The adjustment motion of the charge pressure control element 39 may be transmitted, as indicated in FIG. 4, by means of a hydraulic force amplifier 66, which, though schematically illustrated, may be embodied in known manner, such as a follower piston control element, to use the pressure of the fuel within the interior chamber 24 of the pump 10 as the hydraulic medium.

In FIG. 4, the basic structure of the injection pump 10 having the integrated mechanical rpm regulator 26 is shown in simplified form. A centrifugal regulator 67 in the rpm regulator 26, actuates, via a regulator sleeve 68 and a regulator lever 69, in a known manner, an annular slide 71 which serves as the fuel supply quantity adjustment member of the reciprocating piston, distributor-type injection pump 10. The position of the annular slide 71, which is controlled by the regulator lever 69, controls the termination of fuel supply by the pump 10. In the illustrated full-load position of the regulator elements, the regulator lever 69 is in contact with the tension lever 28, whose position is determined by the position of the full-load stop 13. The initial tension force applied by the regulator spring 72, which retains the tension lever 28 in contact with the full-load stop 13, determines the shutoff rpm level.

Fuel is delivered by a fuel pump 73 from a supply container 74 to the interior chamber 24 acting as a suction chamber. The supply pressure of this fuel is regulated in accordance with rpm by a pressure regulating valve 75. A pump work chamber 77, subjected to the action of a simultaneously reciprocating and rotating pump piston 76, is filled during the suction stroke of the pump piston 76, via a suction bore 78 and inlet control grooves 79 in the pump piston 76; during the compression stroke of the pump piston 76, when the suction bore 78 is closed, fuel is delivered, via an axial bore 81 and a supply groove 82 communicating therewith to a pressure valve 83 and a pressure line 84, and thereupon to an injection nozzle on the engine cylinder, which latter details are not shown. Upon the cessation of fuel supply, a transverse bore 85 in the pump piston 76 communicating with the axial bore 81 is opened by the annular slide 71 to relieve the residual fuel.

The mode of operation of the control apparatus 12 or 12" embodied in accordance with the invention as employed in the reciprocating piston, distributor-type injection pump 10 will now be described again, in summary form, with reference to FIGS. 1–4.

Referring to FIG. 4, the position of the full-load stop 13 determines the position of the tension lever 28 and therewith the position of the annular slide 71 controlling the maximum permissible full-load injection quantity. The position of the full-load stop 13, which forms a part of the stop lever 14, is determined by the axial position of the pickup pin 15, which itself traces the profile of the three-dimensional cam surface 16, and the protuberances thereon, of the three-dimensional cam 17 or 64. The fuel pressure in the interior chamber 24 of the injection pump 10, which is controlled in accordance with the rpm level, acts via the adjustment piston 23 or 61 upon the cam 17, 64 and thus determines the axial position thereof. The rotary position of the cam is controlled by the charge pressure control element 39 in accordance with the charge air pressure prevailing in the intake line of the engine; thus, even during non-steady-state operation of the engine (that is, during acceleration or starting) the full-load injection quantity is controlled in accordance with both rpm level and charge air pressure inputs. As may be seen in FIGS. 2 and 3, a further operating characteristic of the engine can also be used as an input to control the full-load injection quantity, via the third control element 51, so that in every operational state of the engine the maximum permissible full-load fuel quantity injected can be controlled, and thus an optimal acceleration of the engine can be attained, because every operational point can be set up in accordance with the functional characteristics limiting the full-load injection quantity.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A distributor-type fuel injection pump for supercharged Diesel internal combustion engines having a housing and an interior chamber capable of being filled with fuel under pre-supply pump pressure controlled in accordance with rpm, said housing arranged to support a control apparatus and a mechanical rpm regulator, said regulator including a movable lever connected to a supply quantity adjustment member of the injection pump, a full-load stop, the movement of said lever being limited by the position of said full-load stop which determines the maximum permissible full-load supply quantity, said full-load stop being variable by means of a spring urged control member having a cam surface and adjustable by a displaceable charge pressure control element, said control member being associated with said control apparatus and said full-load stop by means of a transmission element which engages the cam surface at said control member, and further wherein said spring urged control member comprises a three-dimensional cam associated with an adjustment shaft and controlled in accordance with rpm and air quantity, said spring including opposite end zones, and said charge pressure control element having a longitudinal extent and further arranged to be displaced relative to an adjustment shaft against said spring by a hydraulically actuated adjustment piston, said adjustment shaft including opposite end portions, each of which are radially and axially supported by means arranged in said housing, said means arranged in said housing including said adjustment piston and an adjustable member secured to said housing.

2. A distributor-type fuel injection pump for supercharged Diesel internal combustion engines according to claim 1, further wherein said adjustment piston forms a movable wall between said interior chamber and another chamber, said other chamber including said three-dimensional cam.

3. A distributor-type fuel injection pump for supercharged Diesel internal combustion engines according to claim 1, further wherein said adjustment shaft is connected via an adjustment gear means to said charge pressure control element.

4. A distributor-type fuel injection pump for supercharged Diesel internal combustion engines according to claim 1, further wherein said opposite end portions of said adjustment shaft includes a spherical area.

5. A distributor-type fuel injection pump for supercharged Diesel internal combustion engines according to claim 1, further wherein one of said means in said housing is cup-shaped and arranged to receive a spherical area provided on said adjustment shaft.

6. A distributor-type fuel injection pump for supercharged Diesel internal combustion engines according to claim 1, further wherein said three-dimensional cam includes oppositely disposed surface areas, one of said areas arranged to abut said adjustment piston, another of said areas arranged to support one of said zones of said spring and further means comprising a counter-support for the other zone of said spring.

7. A distributor-type fuel injection pump for supercharged Diesel internal combustion engines according to claim 6, further wherein said counter-support is provided with a pin member that extends parallel with the longitudinal extent of said adjustment shaft and slidably engages a groove in said three-dimensional cam.

8. A distributor-type fuel injection pump for supercharged Diesel internal combustion engines according to claim 1, further wherein said full-load stop includes a stop lever, said stop lever pivotably supported on a shaft and further means arranged to effect fuel supply by the temperature of engine coolant to thereby correct the positional variation of said full-load stop.

9. A distributor-type fuel injection pump for supercharged Diesel internal combustion engines according to claim 8, further wherein said shaft is eccentrically supported in said pump housing.

10. A distributor-type fuel injection pump for supercharged Diesel internal combustion engines according to claim 1, further wherein said full-load stop includes a stop lever, said stop lever pivotably supported on a shaft and further means arranged to effect fuel supply by the temperature of the charge air to thereby correct the positional variation of said full-load stop.

11. A distributor-type fuel injection pump for supercharged Diesel internal combustion engines according to claim 1, further wherein said full-load stop includes a stop lever, said stop lever pivotably supported on a shaft and further means arranged to effect fuel supply by the exhaust gas to thereby correct the positional variation of said full-load stop.

12. A distributor-type fuel injection pump for supercharged Diesel internal combustion engines according to claim 1, further wherein said three-dimensional cam is positioned in a sealed chamber and said displaceable charge pressure control element is disposed in another sealed chamber.

13. A distributor-type fuel injection pump for supercharged Diesel internal combustion engines according to claim 12, further wherein said sealed chamber of said three-dimensional cam communicates with an oil leakage line which extends through a pressure-free fuel return line to said injection pump.

* * * * *